United States Patent [19]

Rostron et al.

[11] 4,307,274

[45] Dec. 22, 1981

[54] CIRCUIT INTERRUPTER USING DIELECTRIC LIQUID WITH ENERGY STORAGE

[75] Inventors: Joseph R. Rostron, Marrysville; William H. Fischer, Pittsburgh; Charles F. Cromer, Trafford; Sylvester J. Dropik, Jeannette; Kent D. Daschke, Greensburgh, all of Pa.

[73] Assignee: Electric Power Research Institute, Inc., Palo Alto, Calif.

[21] Appl. No.: 121,157

[22] Filed: Feb. 13, 1980

Related U.S. Application Data

[63] Continuation of Ser. No. 818,004, Jul. 22, 1977.

[51] Int. Cl.[3] ..... H01H 33/68

[52] U.S. Cl. ..... 200/150 R; 200/150 B; 200/150 G

[58] Field of Search ..... 200/150 R, 150 A, 150 G, 200/150 B

[56] References Cited

U.S. PATENT DOCUMENTS

| | | | |
|---|---|---|---|
| 2,061,945 | 11/1936 | Koppelmann et al. | 200/150 G |
| 3,406,269 | 10/1968 | Fischer | 200/150 A |
| 4,009,358 | 2/1976 | Gratzmuller | 200/150 B |

FOREIGN PATENT DOCUMENTS

| | | | |
|---|---|---|---|
| 1127442 | 4/1962 | Fed. Rep. of Germany | 200/150 M |
| 174182 | 12/1934 | Switzerland | 200/150 G |

*Primary Examiner*—Robert S. Macon

*Attorney, Agent, or Firm*—Flehr, Hohbach, Test, Albritton & Herbert

[57] ABSTRACT

A circuit interrupter uses a dielectric liquid such as sulphur hexachloride to extinguish arcs in an interrupter. The liquid is injected at a relatively high pressure by a pump piston with a relatively high mass and an accumulator acts as a pressure fly wheel to effectively reduce high pressure maximums and increase low pressure minimums because of the much lower mass of the accumulator piston. In addition, a double fluid flow interrupter is provided.

4 Claims, 5 Drawing Figures

CIRCUIT INTERRUPTER USING DIELECTRIC LIQUID WITH ENERGY STORAGE

This is a continuation of application Ser. No. 818,004 filed July 22, 1977.

BACKGROUND OF THE INVENTION

The present invention is directed to a circuit interrupter using dielectric liquid with energy storage.

Liquified gas circuit interrupters are well-known one being disclosed in U.S. Pat. No. 3,150,245 to W. M. Leeds et al. as inventors. Leeds discloses a fluid such as sulphur hexafluoride and provides driving means for forcing the liquified gas at high pressure toward the arc zone when the contacts of the interrupter are parted. One of the problems pointed out in Leeds is maintaining a high enough pressure especially during the low temperature ambient operation for effective arc extinguishing. In order to maintain an adequate injection pressure, Leeds proposes three techniques which are (1) the use of a mechanically operated impulse device, (2) the use of an accumulator with gas such as nitrogen in one end and sulphur hexachloride in the other, and (3) the use of sulphur hexachloride and a heater to maintain a high enough temperature.

A problem with the Leeds design is the remarkable rise in the fault current interrupting requirements in the past decade. For example, Leeds is directed to interrupting perhaps 50,000 amperes with pressures which are generally less than 1,000 psi. In contrast with a current of for example 120,000 amperes, as much as 2,000 psi may be required. With the required high pressure two problems are presented. One is that when an arc is formed upon separation of the contacts the arc in essence shuts off the flow of interrupting fluid and causes an incipient high pressure maximum. This pressure may be much higher in fact than the required arc extinguishing pressure and subjects the entire interrupter device to severe mechanical stress. On the other hand, when the arc is near current zero, the arc diameter reduces thus allowing the liquid to flow out the orifices more rapidly. This tends to reduce the pressure below an acceptable level in which an arc might be re-established. In other words, a low pressure minimum may be produced by rapidly increasing flow area while the pump has a slow response to these changing conditions.

Fischer U.S. Pat. No. 3,406,269 discloses in FIGS. 5 and 6 techniques (including an accumulator) for maintaining sufficient pressures. However, since the systems are closed there is no pressure minimum problem.

OBJECTS AND SUMMARY OF THE INVENTION

It is, therefore, a general object of the present invention to provide an improved circuit interrupter which is capable of effectively operating at relatively high fault currents.

It is a further object of the invention to produce an interrupter where pressure variations are minimized.

It is another object of the invention to provide a double flow interrupter having improved interruption.

In accordance with the above objects there is provided a circuit interrupter using a dielectric fluid. The resultant arc formed in the nozzles from interrupting temporarily block the flow of the fluid in phase with current peaks and cause an incipient high pressure maximum. Extinguishment of the arc which occurs near zero causes an incipient low pressure minimum. Movable and fixed contacts are retained in at least a partially confined enclosure. Means are provided for introducing the dielectric fluid into the enclosure at a predetermined initial high pressure. Energy storage means are responsive to the high pressure fluid and changes in the fluid flow for smoothing the resultant pressure of the fluid by reducing the pressure maximum and increasing the pressure minimum.

DETAILED DESCRIPTION OF THE PREFERRED EMBODIMENT

Figure 1:
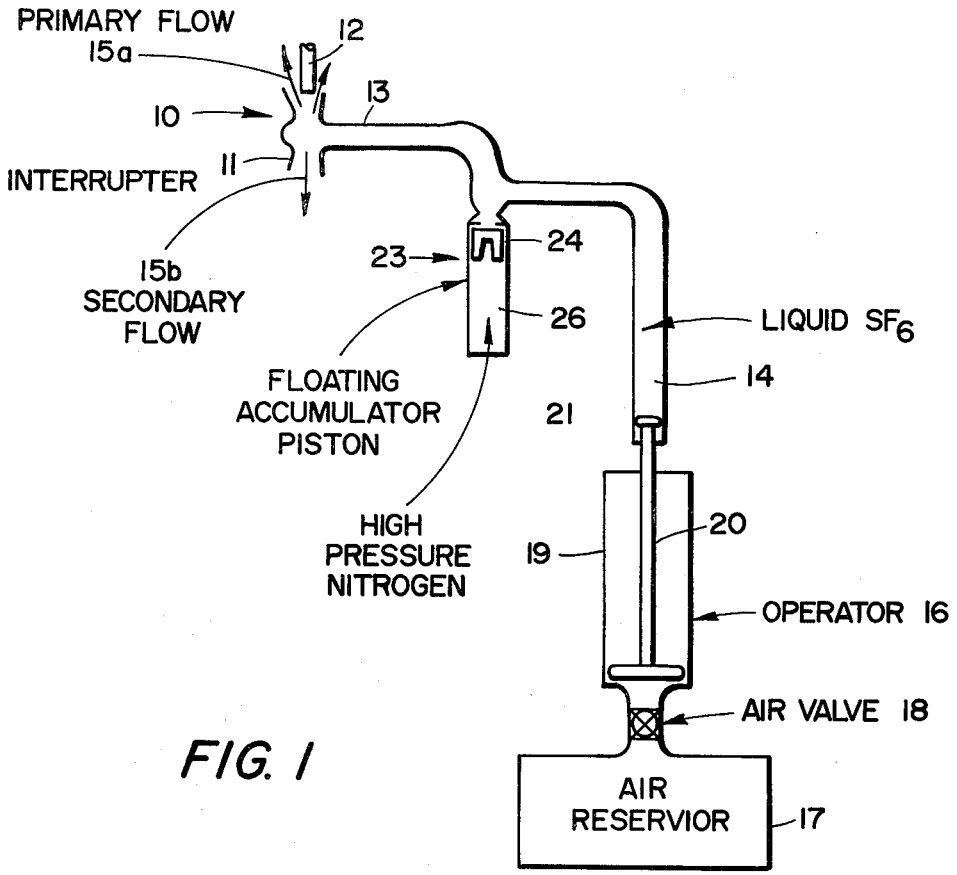
FIG. 1 is a simplified diagram of an interrupter embodying the present invention.

Referring to FIG. 1, an interrupter 10 is shown having fixed contacts 11 and a movable contact 12. Normally these contacts would be contained in at least a partially confined enclosure which will be shown in greater detail below. The enclosure has a secondary flow path **15*b* formed by the parting of contact 12 from fixed contacts 11 (which form a nozzle) and a primary flow path 15*a* in an opposite direction to path 15*b*. An entrance port 13 of the interrupter is connected to a source 14 of dielectric liquid such as sulphur hexachloride ($SF_6$). Liquid source 14 is pumped by air operator 16 driven by high pressure air from the reservoir 17 through an air valve 18. The operator 16 includes a cylinder 19 containing a piston 20 having a head 21 which pumps source 14. A typical high pressure which might be produced by pumped source 14** is 2,500 psi.

Air valve 18 is operated or placed in an open condition when the moving contact 12 of the interrupter is parted from fixed contact 11.

Intermediate the entrance port 13 and the dielectric fluid source 14 is energy storage means or accumulator 23. It includes a floating piston 24 and a reservoir of high pressure nitrogen 26. Floating piston 24 obviously has an effective mass much less than that of pump piston 20. A typical nitrogen pressure might be from 1,700 to 2,000 psi. In other words, a greater pressure than the pumped source 14. In operation accumulator 23 acts effectively as a pressure surge protector. It tends to resist any pressure change in fluid system. This is accomplished by storing potential energy in the accumulator 23 as the system pressure tends to rise (as for example where the arc is clogging or blocking the flow of liquid) and giving up energy as the system pressure tends to drop (as for example when the arc is small and the flow area is increased and the parted contact allows a hydrodynamic surge of the liquid or gas out of the interrupter as shown by the flow paths **15*a* and 15*b***).

Figure 2:
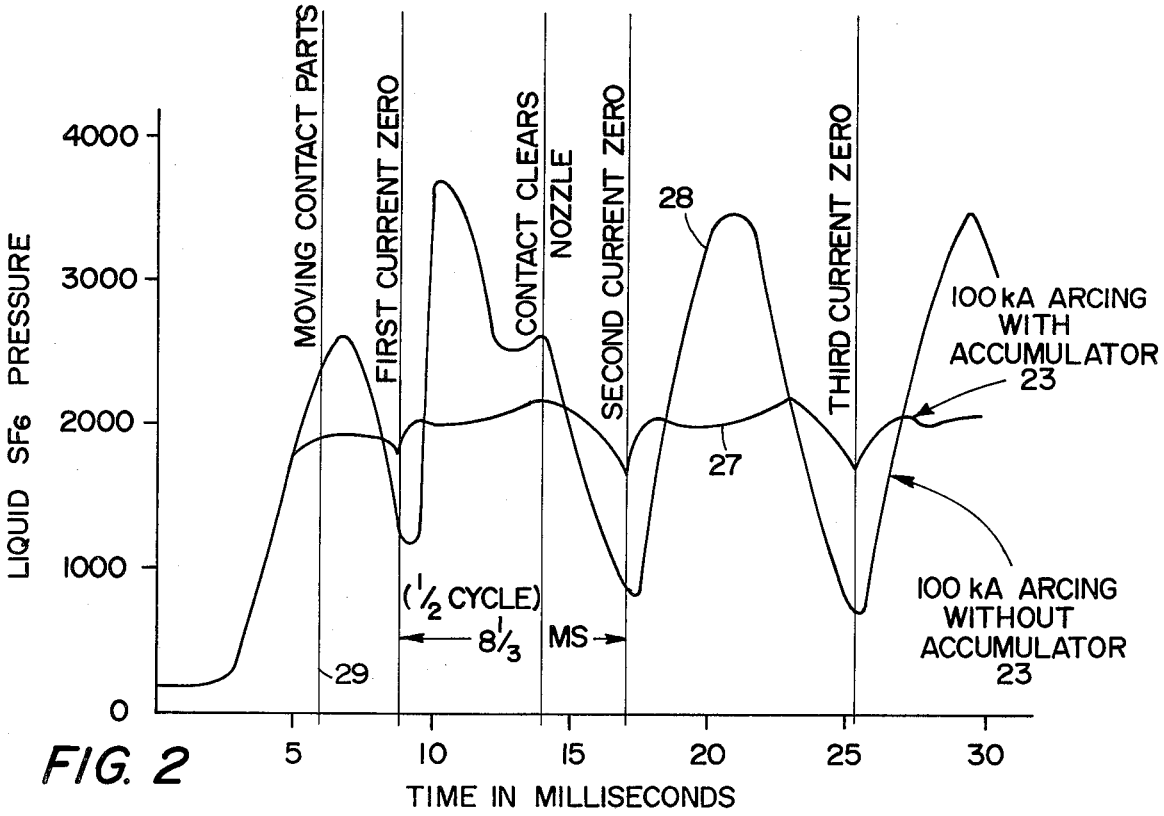
FIG. 2 is a set of curves illustrating the operation of the interrupter of FIG. 1 and its improvement over the prior interrupters.

The accumulator therefore reduces pressure peaks and increases pressure minimums. It is a pressure leveler as clearly illustrated in FIG. 2 where the curve 27 designated "100 kA arcing with accumulator" shows a variation of approximately 300 psi whereas in comparison in curve 28 without the accumulator 23 there would have been a variation of 3,000 psi. The graph of FIG. 2 charts the operation of the interrupter through a time interval of three current zeros as indicated which occur at half cycle intervals. These occur at intervals of $8\frac{1}{3}$ milliseconds assuming the frequency is 60 Hz and the current is symmetrical. At the time 29 moving contact 12 parts and the wide oscillation in curve 28 is caused by the arc blocking the flow of dielectric and the high inertia of the pump piston 21 of FIG. 1. An improvement provided by the present invention is the increase of pressure at the second current zero from 700 to 1,700 psi. The pressure was also greatly reduced from 3,700 psi to 2,200 psi. As discussed above, two advantages are obtained. The increase in pressure at current zero where interruption takes place will improve interruption. Secondly, the reduced peak pressures between current zeros will reduce the mechanical stresses on the interrupter and the interrupter support structure.

Figure 3:
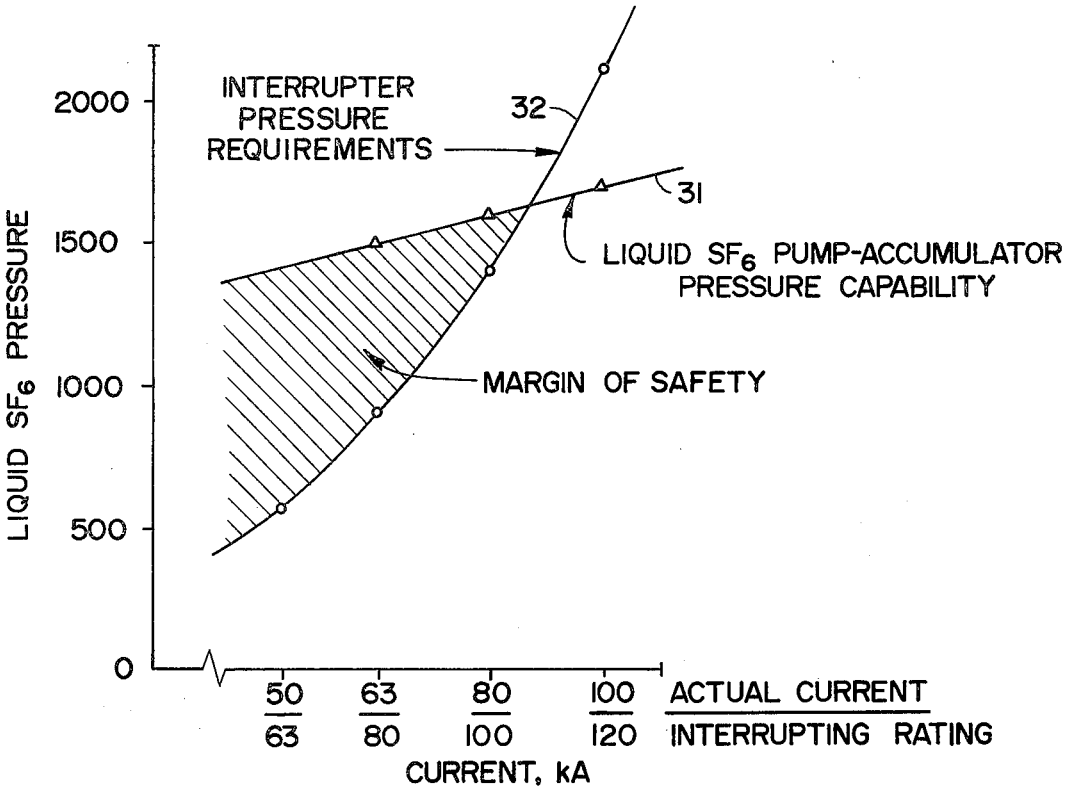
FIG. 3 is a graph showing interrupter pressure requirements.

FIG. 3 is a set of curves illustrating the liquid sulphur hexachloride pump accumulator pressure capability 31 and the necessary interrupter pressure requirement curve 32 for various current ratings shown on the horizontal line of the graph with actual current and interrupting ratings being indicated. Thus, the pump accumulator pressure capability (which corresponds to the current zero pressure of curve 27 of FIG. 2) depending on the current to be interrupted should be designed accordingly.

In addition, the accumulator system should be optimized for each respective interruption current rating by varying the nitrogen pressure behind the accumulator piston 24. Non-optimum accumulator pressure will cause the piston to respond too quickly or too slowly. Either of the foregoing situations can allow the liquid dielectric pressure to drop below the maximum at current zero. The various interrupting currents and optimum nitrogen fill have the following typical values.

| Interrupting Current | Accumulator Charge Pressure |
|---|---|
| 120 kA | 2,000 psig |
| 100 kA | 1,900 psig |
| 80 kA | 1,800 psig |
| 63 kA | 1,700 psig |

Accumulator 23 of FIG. 1 can be varied in design such as using a spring instead of nitrogen as the energy storage means. In addition, a rubber bladder or metal bellows could be used in place of the floating piston. Finally, the design could allow the liquid sulphur hexachloride to be in direct contact with the nitrogen with no separator being used.

Also although liquid sulphur hexachloride is the preferred liquid other liquids may be used such as those disclosed in the Leeds patent.

The operator 16 driving liquid source 14 must have a relatively high mass in order to provide the necessary high forces required to provide the high pressure necessary to arc interruption. With such a high mass naturally the response is relatively slow compared to the accumulator 23; (for example, the floating piston may have a weight of two pounds) since its effective mass is typically 1/10 or less that that of the pump system, it responds to changes in the flow condition much more rapidly thus minimizing swings in pressure. Thus, in general the energy storage means in the form of accumulator 23 must be designed with piston 24 having an effective mass much less than the effective mass of the liquid dielectric introducing means which includes the pump 20 and 21 and source fluid 14. Such introducing means must generate as much as 200,000 hp for 20 milliseconds.

Figure 4:
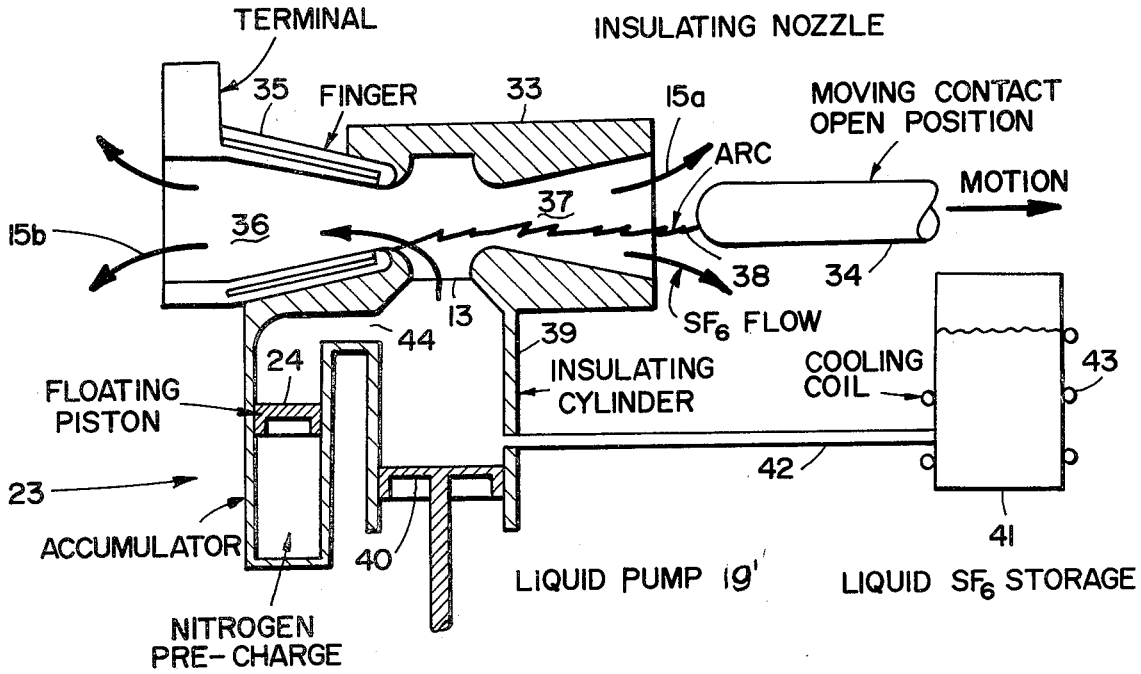
FIG. 4 is a more detailed cross-sectional view of an interrupter embodying the invention which is patterned after FIG. 1.

FIG. 4 illustrates a practical embodiment of the theoretical configuration of FIG. 1 where an insulating nozzle 33 receives moving contact 34 and the metal fingers 35 which form the fixed contact. An entrance port 13 is formed in nozzle 33 to allow passage of the dielectric fluid in its secondary flow path **15*b* only when the moving contact 34 is being parted. This effectively retains the fluid in close proximity to the contact area. On removal of contact 34 the fluid flows in two opposite directions 15*a* and 15*b* through nozzle 36 formed by the fixed contact 35 and through insulating nozzle throat 37 to extinguish the arc 38. Coupled to entrance port 13 is the insulating cylinder 39 having the pump piston 40. Cylinder 39 is connected to a liquid sulphur hexafloride storage unit 41 by pipeline 42. Cooling coils 43 are provided for storage unit 41**. The use of said coils in maintaining the $SF_6$ in a liquid state in a similar type of contact structure as is disclosed and claimed in copending application Ser. No. 121,165, filed Feb. 13, 1980, and entitled CIRCUIT INTERRUPTER USING A MINIMUM OF DIELECTRIC LIQUID.

Accumulator 23 is connected at a port 44 the upper portion of cylinder 39.

Figure 5:
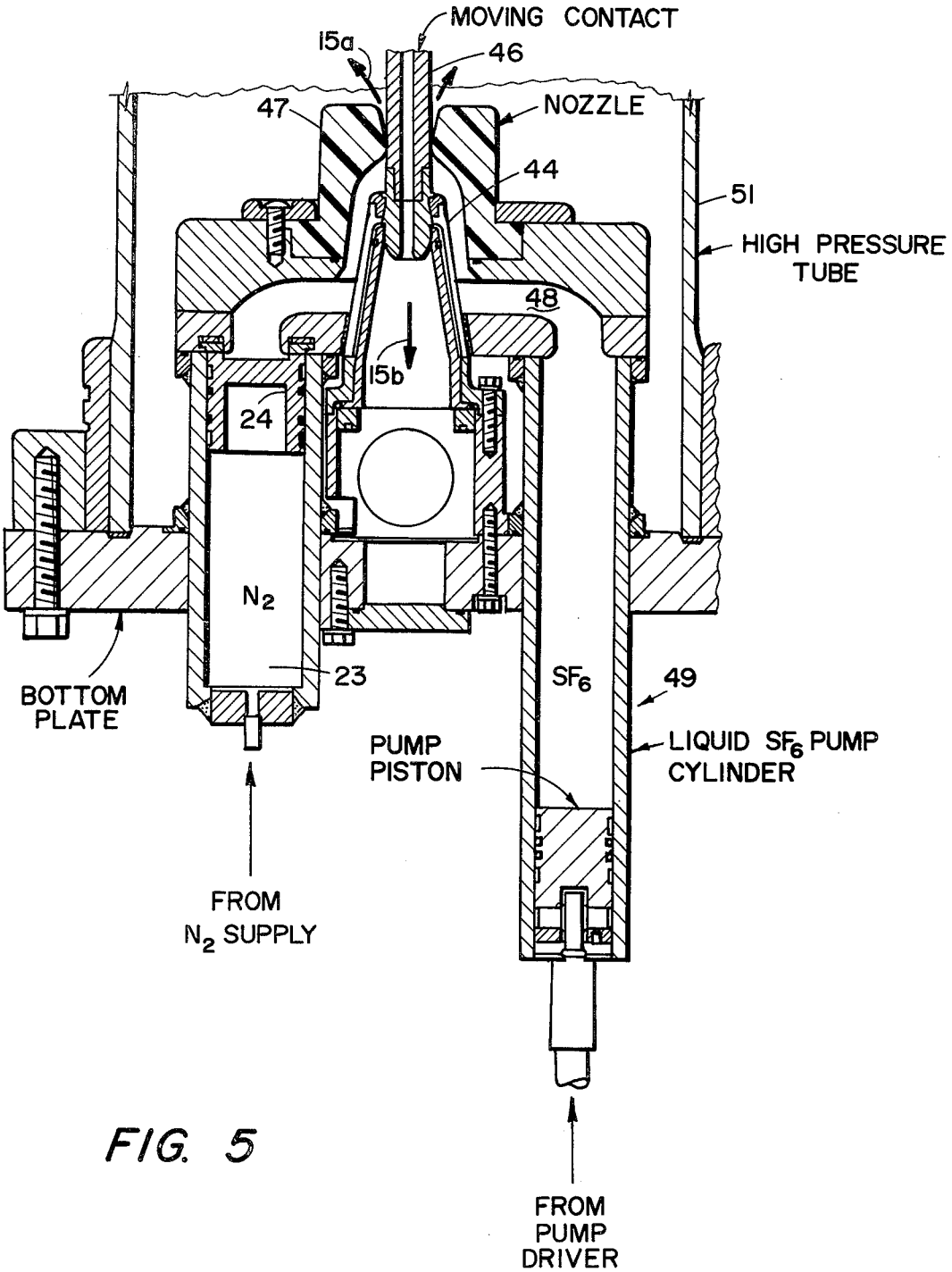
FIG. 5 is a cross-sectional view of an alternative embodiment of an interrupter embodying the present invention.

FIG. 5 is an alternative embodiment of the interrupter where stationary or fixed contacts 44 are normally engaged by the moving contact 46 which moves in an insulating nozzle 47 for example made of TEFLON (trademark). In an annular space 48 on one side is a dielectric liquid pump system 49 and on the other an accumulator 23'. A high pressure tube 51 surrounds the entire apparatus. Accumulator 23' includes the free-floating piston 24'. The double flow paths **15*a* and 15*b* are indicated by arrows. The initial liquid level of $SF_6$ covers up to and including the narrow throat of nozzle 47**.

If desired the annular space 48 can accommodate an additional pump and accumulator for greater interrupting capacity.

Thus the present invention has provided an improved liquid interrupter which can effectively interrupt relatively high fault currents.

What is claimed is:

1. A circuit interrupter using a dielectric liquid introduced into the interrupter at a high pressure, the resultant arc formed from interrupting temporarily blocking the flow of said liquid and normally causing a high pressure maximum and extinguishment of said arc near a current zero normally causing a low pressure minimum, said interrupter comprising: movable and fixed contacts retained in at least a partially confined enclosure; means for introducing said dielectric liquid into said enclosure at a predetermined initial high pressure; energy storage means responsive to said high pressure liquid and changes in said liquid flow for smoothing, during circuit interruption the resultant pressure of said liquid by reducing said pressure maximum and increasing said pressure minimum, said enclosure including a first nozzle formed by said fixed electrical contacts converging to a narrow throat and a second electrical insulating nozzle having a narrow throat opposite said throat of said first nozzle, said movable contact normally in its closed condition, extending through said throat of said second nozzle and into said throat of said first nozzle to make electrical contact with said fixed contacts, said enclosure including an entrance port for said introduction of said liquid between said throats of said nozzles said moving contact in said closed condition effectively closing said port said moving contact when opened being withdrawn from both of said nozzle throats to provide a bidirectional flow path for said liquid in opposite directions with a primary flow path through the narrow throat and a diverging portion of said second nozzle and a secondary flow path through said narrow throat and a diverging portion of said first nozzle.

2. A circuit interrupter as in claim 1 where said energy storage means includes a floating piston movable in a cylinder filled with gas.

3. A circuit interrupter as in claim 1 where said liquid is liquid $SF_6$.

4. A circuit interrupter as in claim 1 where said energy storage means has an effective mass much less than said introducing means.

* * * * *

UNITED STATES PATENT AND TRADEMARK OFFICE

CERTIFICATE OF CORRECTION

PATENT NO. : 4,307,274

DATED : December 22, 1981

INVENTOR(S) : Joseph R. Rostron, William H. Fischer, Charles F. Cromer, Sylvester J. Dropik, Kent D. Daschke It is certified that error appears in the above-identified patent and that said Letters Patent are hereby corrected as shown below:

On the Title page:

In the second line of the Abstract, change "hexachloride" to ---hexafluoride---.

In Column 1, lines 24 and 25, change "hexachloride" to ---hexafluoride---.

In Column 2, lines 38 and 39, change "hexachloride" to ---hexafluoride---.

In Column 3, line 23, change "hexachloride" to ---hexafluoride---.

In Column 3, lines 54, 55 and 57, change "hexachloride" to ---hexafluoride---.

Signed and Sealed this

Nineteenth Day of October 1982

[SEAL]

Attest:

GERALD J. MOSSINGHOFF

Attesting Officer

Commissioner of Patents and Trademarks